United States Patent [19]

Ikeda et al.

[11] Patent Number: 4,801,275

[45] Date of Patent: Jan. 31, 1989

[54] CONNECTOR LOCK DEVICE

[75] Inventors: Tomohiro Ikeda; Mitsuhiko Totsuka, both of Shizuoka, Japan

[73] Assignee: Yazaki Corporation, Japan

[21] Appl. No.: 126,717

[22] Filed: Nov. 30, 1987

[51] Int. Cl.[4] ..... H01R 13/627

[52] U.S. Cl. ..... 439/350; 439/357; 439/358; 439/366

[58] Field of Search ..... 439/350, 355, 356, 357, 439/358, 366, 592

[56] References Cited

U.S. PATENT DOCUMENTS

| | | | |
|---|---|---|---|
| 3,417,365 | 12/1968 | Krehbiel | 439/358 X |
| 4,010,998 | 3/1977 | Tolnar, Jr. et al. | 439/358 X |
| 4,026,624 | 5/1977 | Boag | 439/357 X |
| 4,272,145 | 6/1981 | LaDuke | 439/358 X |
| 4,319,797 | 3/1982 | Otani et al. | 439/358 X |
| 4,376,563 | 3/1983 | Margrave et al. | 439/358 X |
| 4,623,210 | 11/1986 | Tsukakoshi | 439/358 X |
| 4,658,107 | 4/1987 | Hildebrandt | 439/350 X |
| 4,708,413 | 11/1987 | Schroeder | 439/358 |
| 4,714,433 | 12/1987 | Rider, Jr. | 439/357 X |

FOREIGN PATENT DOCUMENTS

| | | | |
|---|---|---|---|
| 2630578 | 1/1977 | Fed. Rep. of Germany | 439/350 X |
| 2082402 | 3/1982 | United Kingdom | 439/357 X |

*Primary Examiner*—William L. Sikes
*Assistant Examiner*—Brian M. Healy
*Attorney, Agent, or Firm*—Wigman & Cohen

[57] ABSTRACT

The connector lock device for locking two connector housings comprises a roughly triangular protrusion member provided on a first connector housing and an E-shaped latch level member mounted on a second connector housing. The latch lever member includes a central leg portion extending from a movable transverse portion in parallel to and between the two leg portions and formed with a slot and two projected fulcrum portions and a flat depression portion. To lock the two connector housings, the protrusion member is inserted into the slot of the latch lever member. To unlock the two connector housings, the flat depression portion is depressed to pivot the central leg portion about the two fulcrums to release the protrusion member from a claw portion of the movable transverse portion.

5 Claims, 3 Drawing Sheets

CONNECTOR LOCK DEVICE

BACKGROUND OF THE INVENTION

1. Field of the Invention

The present invention relates to a connector lock device and more specifically to a device for locking and unlocking a pair of mated connector housings.

2. Description of the Prior Art

Various locking devices for securing two electrical connectors together are known. However, an easy connection and an easy disconnection are required for the locking devices, while maintaining a secure connection. An example of prior-art connector lock devices is disclosed in U.S. Pat. No. 4,272,145, issued June 9, 1981 for "CONNECTOR LOCK RELEASE", this patent being hereby incorporated by reference.

In the above-mentioned prior-art connector lock device, since the effective length of the locking lever (based upon a handspike) is relatively short, a relatively great depression force is required to release the engagement between two male and female connector housings. On the other hand, when the effective length thereof is increased, there exists another problem in that the size of the lock device inevitably increases. Further, there exists another problem in that a lock release force is concentrated at a top of a mating protrusion portion of the device and therefore it is necessary to reinforce the top of the mating protrusion portion thereof.

The arrangement of the prior-art connector lock device will be described in further detail hereinafter with reference to the attached drawings under DETAILED DESCRIPTION OF THE PREFERRED EMBODIMENT.

SUMMARY OF THE INVENTION

With these problems in mind, therefore, it is the primary object of the present invention to provide a small-sized connector lock device which can permit easy locking and unlocking operation when a pair of male and female connector housings are mated or unmated.

To achieve the above-mentioned object, a connector lock device for locking two connector housings, according to the present invention, comprises: (a) a roughly triangular protrusion member provided on a first connector housing; (b) a roughly E-shaped latch lever member provided on a second connector housing to cooperate with said triangular protrusion member to lock and unlock the two connector housings at a mated position, having: (1) a first leg portion having a fixed end and a free end; (2) a second leg portion having a fixed end and a free end; (3) a transverse portion for connecting the two free ends of said first end second leg portions integral into a U-shape, said transverse portion being formed with a claw portion engageable with said protrusion member; (4) a third leg portion extending from said transverse portion in parallel to and between said first and second leg portions and formed with a slot extending in a longitudinal direction thereof at an middle portion thereof, two projected fulcrum portions inside and near the middle thereof, and an outer flat depression portion at one end thereof remote from the transverse portion; and (c) when the two connector housing are coupled to each other, said triangular protrusion member deflecting said latch lever member by urging the claw portion of the transverse portion of said latch member into a locked position where said protrusion member is fitted into the slot of the second leg portion; and when the flat depression portion depressed and thereby the latch lever member is pivoted about the two projected fulcrum portions, the claw portion of the transverse portion being disengaged from said triangular protrusion member into an unlocked position where said protrusion member can be released from the slot of the second leg portion.

BRIEF DESCRIPTION OF THE DRAWINGS

The features and advantages of the connector lock device according to the present invention will be more clearly appreciated from the following description of the preferred embodiment of the invention taken in conjunction with the accompanying drawings in which like reference numerals designate the same or similar elements or sections throughout the figures thereof and in which:

FIGS. 3(A), (B) and, (C) are cross-sectional views taken along the line A'A shown in FIG. 2A, in which FIG. 3(A) shows a locked condition.

DETAILED DESCRIPTION OF THE PREFERRED EMBODIMENTS

To facilitate understanding of the present invention, a brief reference will be made to a prior-art connector lock device, with reference to the attached drawings.

Figure 1A:
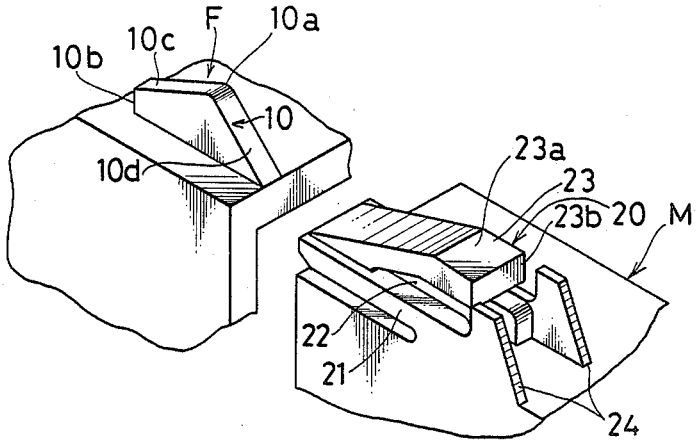
FIG.1A (Prior Art)
FIG. 1A is a partial perspective view of a prior-art connector lock device including a mating protrusion member and latch assembly.

In FIG. 1A, a prior-art connector lock device includes a female electrical connector housing F with a roughly-triangular mating protrusion member 10 engaged with a latch assembly 20 fixed to a male electrical connector housing M. The latch assembly 20 includes a U-shaped locking arm 21 with a slot 22 which rides over a slope **10*d* of the mating protrusion member 10. To disengage the latch assembly 20 from the mating protrusion member 10, a lever arm 23 connected to the locking arm 21 is tilted about the peak 10*a* of the mating protrusion member 10, to raise the locking arm 21 and free the mating protrusion member 10 from the slot 22**.

Figure 1B:
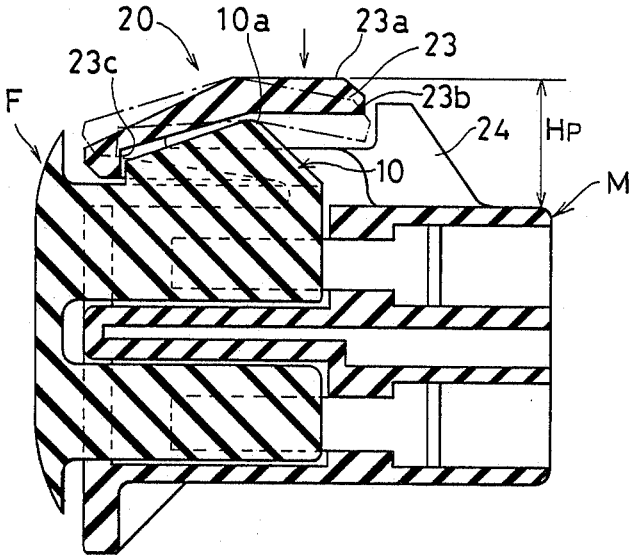
FIG.1B (Prior Art)
FIG. 1B is a sectional view of the prior-art connector lock device shown in FIG. 1A, in which a unlock position is shown by dot-dashed lines.

With reference to FIG. 1B, when the female connector housing F is required to be disconnected from the male connector housing M, the lever arm 23 is depressed. A force (indicated by an arrow) applied to a flat portion **23*a* of the lever arm 23 causes the bottom of the lever are 23 to engage a top fulcrum 10*a* of the mating protrusion member 10 and pivot as indicated by dot-dashed lines in FIG. 1B. When the lever arm 23 pivots, the attached U portion 23*c* of the locking arm 21 is raised sufficiently above the top of a rear wall 10*b* of the protrusion member 10, so that when two connector housings F and M are pulled apart, the locking arm 21 rides up a leftward inclined surface 10c of the protrusion member 10, over the top fulcrum 11 and down the rightward inclined surface 10*d*. When the two housings F and M are pulled apart, the locking arm 21** is cantilevered to the original position.

In the above-mentioned prior-art connector lock device as described above, in order to release the engagement between the two connector housings F and M, it is necessary to depress downward the flat portion 23*a* of the lever arm 23 to such an extent that the U portion 23*c* of the locking arm 21 is moved upward over the vertical wall 10*b* of the protrusion member 10 when the lever arm 23 is pivoted about the top fulcrum 10*a*. In order to reduce the depression force applied to the lever 23 for easy disconnection, it is necessary to increase a distance between the top fulcrum 10*a* to an end 23*b* of the lever arm 23 as compared with a distance between the top fulcrum 10*a* to the other end 23*c* thereof. In this case, the height Hp of the flat portion 23*a* of the lever arm 23 is inevitably increased and therefore the height of protection walls 24 (shown in FIG. 1A) also increases, thus resulting in a problem in that the size or dimension of the connector lock device increase. In addition, there exists another problem in that a release force is concentrated at the top fulcrum portion 10*a* of the mating protrusion member 10 and therefore it is necessary to reinforce the top surface of the mating protrusion member 10.

In view of the above description, reference is now made to an embodiment of the connector lock device according to the present invention.

Figure 2A:
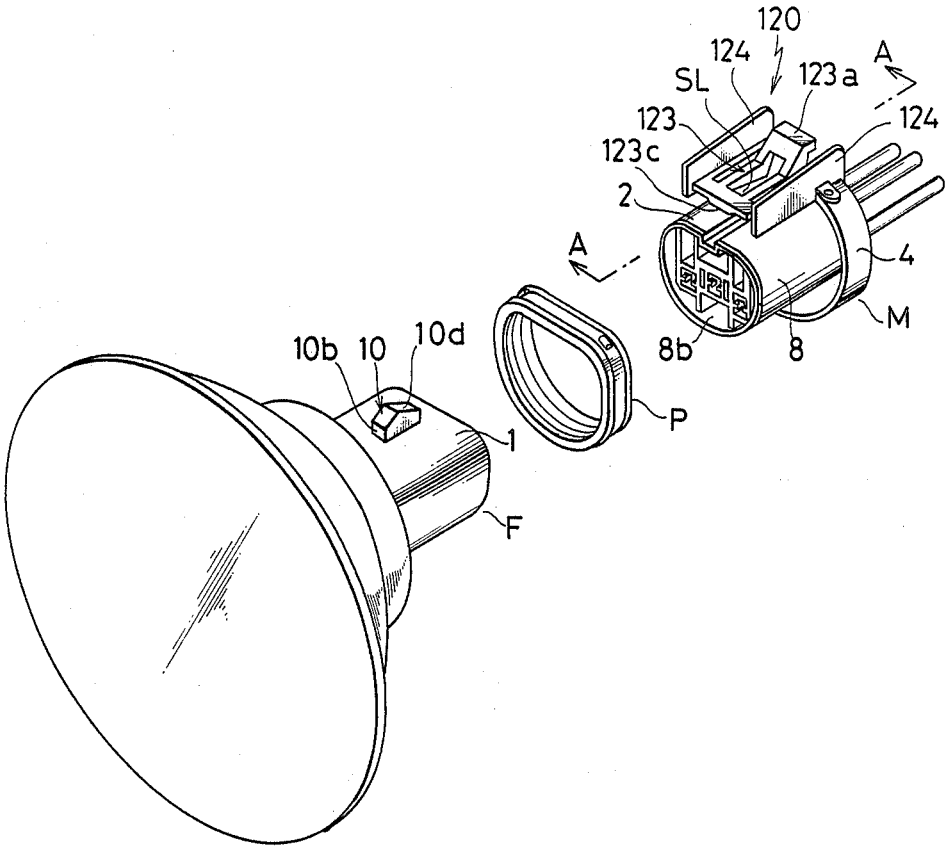
FIG. 2A is a perspective view showing a connector lock device of the present invention.

With reference to FIG. 2A, a female connector housing F and a male connector housing M are coupled to each other with a packing P intervening between the two housings F and M, and locked by a connector lock device composed roughly of a mating protrusion member 10 and a latch lever member 120. The mating protrusion member 10 is generally triangular in shape so as to cooperate with the latch lever member 120. The protrusion member 10 is formed integral with or provided on an upper flat wall 1 of the female connector housing F.

The latch lever member 120 is generally E-shaped and fixed to a frame body 8 of the male connector housing M via an annular mounting fixture 4 at an end remote from an opening end 8*b* of the housing M. The latch lever member 120 extends along the frame body 8 to near an open end thereof, and is supported by a pair of protection walls 124. This protection walls 124 serve to prevent the latch lever member from being unlocked due to an unexpected external force.

Figure 2B:
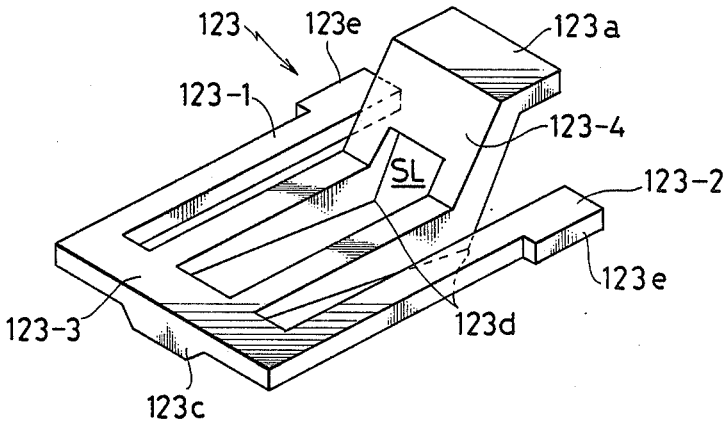
FIG. 2B is an enlarged perspective view showing only a latch lever member of the connector lock device shown in FIG. 2A.

In more detail, with reference to FIG. 2B, the E-shaped latch lever member 120 comprises a first leg portion 123-1 having a fixed end 123e fixed to the protrusion wall 124 and a free end; a second leg portion 123-2 having a fixed end 123*e* also fixed to the protection wall 124 and a free end; a transverse portion 123-3 for connecting the two free ends of the first and second leg portions 123-1 and 123-2 integral into a U-shape and formed with a claw portion 123*c* engageable with the protrusion member 10; and a third leg portion 123-4 extending from the transverse portion in parallel to and between the first and second leg portions. The third leg portion 123-4 is formed with a slot SL extending in the longitudinal direction of the third leg portion 123-4 at the middle portion thereof, two projected fulcrum portions 123*d* near the middle thereof, and a flat depression portion 123*a* at one end thereof remote from the transverse 123-3. This flat depression portion 123*a* extends outward from the connector housing M at an acute angle with respect to the third leg portion 123-4.

Figure 3A:
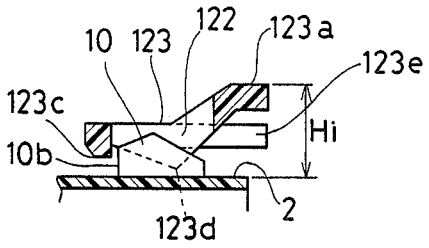

As depicted in FIG. 3(A), the latch lever member 123 is formed with a flat portion 123*a* at one end thereof, a claw portion 123*c* at the other end thereof and a bottom fulcrum 123*d* at the intermediate portion thereof. Here, it should be noted that the bottom fulcrum 123*d* is away from the upper surface 2 of the male connector housing M but brought into contact with the upper surface 2 of the housing M, when the flat portion 123*a* is depressed, for permitting a pivotal motion of the latch lever member 123 about the bottom fulcrum 123*d*.

The operation of the connector lock device according to the present invention will be described hereinbelow with reference to FIGS. 3(A), (B) and (C).

To lock the two connector housings F and M, the frame body of the female connector housing F is mated to the outer circumference of the frame body 8 of the male connector housing M. When both the housings are pushed to each other, the mating protrusion member 10 is fitted to the slot SL of the latch lever member 123 into engagement between the two, because the inclined surface 10*d* of the protrusion member 10 pushes upward the claw portion 123*c* of the transverse portion 123-3 of the latch lever member 123 and therefore the claw portion 123*c* is engaged with the wall 10*b* of the protrusion member 10. In the above locking operation, the latch lever member 123 is pivoted at a fixed end 123*e* (see FIGS. 2B and 3A) of the latch lever member 123. FIG. 3(A) shows the above-mentioned locked positional relationship between the mating protrusion member 10 and the latch lever member 120.

Figure 3B:
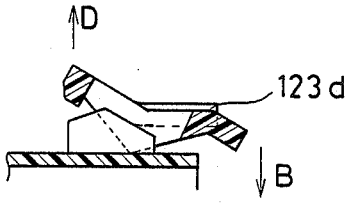
FIG. 3(B) shows an unlocked condition before two connector housings are released.
Figure 3C:
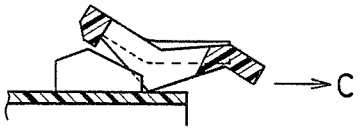
FIG. 3(C) shows the unlocked condition after two connector housings have been released.

To unlock the two connector housings F and M, the flat portion 123*a* of the latch lever member 123 is depressed, as shown by arrow B in FIG. 3(B). Therefore, the latch lever member 123 is first lowered until the bottom fulcrum 123*d* is brought into contact with the upper surface of the housing M and then pivoted with the bottom fulcrum 123*d* as its pivotal center, until the claw portion 123*c* of the latch lever member 123 is moved beyond the top of the mating protrusion member 10 as shown by arrow D in FIG. 3(B). That is, FIG. 3(B) shows the above-mentioned unlocked (released) positional relationship between the mating protrusion member 10 and the latch lever member 120. Under the unlocked condition, the two connector housings F and M can be freely separated from each other in the direction C as shown in FIG. 3(C).

As described above, in the connector lock device of the present invention, since the mating protrusion member 10 is fitted into a slot SL formed at the middle portion of the latch lever member 12*e* and further the pivotal axis (fulcrum) of the latch lever member 120 is positioned on the outer circumference of the connector housing (in the prior-art device, the protrusion member 10 is positioned under the lever arm 23 and the pivotal axis of the lever arm 23 is positioned at top of the protrusion member 10), it is possible to reduce the height Hi (see FIG. 3A) of the flat portion 123*a* of the latch lever member 120 from the outer circumference of the housing as compared with that Hp of the prior-art connector lock device shown in FIGS. 1(A) and (B). In addition, since the latch lever member 120 is pivoted about two fulcrums 123*d* (in the prior-art device, the lever arm 23 is pivoted about a single fulcrum 10*a*), it is possible to divide an unlocking force into two positions and therefore reduce force concentrated at the fulcrum point. In other words, it is unnecessary to reinforce the fulcrum of the latch lever member 120 in particular.

What is claimed is:

1. A connector lock device for locking two connector housings, which comprises:

(a) a roughly triangular protrusion member provided on a first connector housing; and (b) a roughly E-shaped latch lever member provided on a second connector housing to cooperate with said triangular protrusion member to lock and unlock the two connector housings at a mated position, said latch member being formed with a slot at a middle leg portion thereof into which said protrusion member is accommodated at a locked position when the two connector housing are coupled to each other, a claw portion engageable with said protrusion member at the locked position, an outer flat depression portion at one end thereof, and two projected fulcrum portions contactable with the second connector housing, for pivoting said latch lever member away from said protrusion member into an unlocked position when the outer flat depression portion is depressed.

2. A connector lock device for locking two connector housings, which comprises:

(a) a roughly triangular protrusion member provided on a first connector housing;

(b) a roughly E-shaped latch lever member provided on a second connector housing to cooperate with said triangular protrusion member to lock and unlock the two conenctor housings at a mated position, having:

(1) a first leg portion having a fixed end and free end;

(2) a second leg portion having a fixed end and a free end;

(3) a transverse portion for connecting the two free ends of said first and second leg portions integral into a U-shape, said transverse portion being formed with a claw portion engageable with said protrusion member;

(4) a third leg portion extending from said transverse portion in parallel to and between said first and second leg portions and formed with a slot extending in a longitudinal direction thereof at an middle portion thereof, two projected fulcrum portions inside and near the middle thereof, and a flat depression portion at one end thereof remote from the transverse portion; and (c) when the two connector housings are coupled to each other, said triangular protrusion member deflecting said latch lever member by urging the claw portion of the transverse portion of said latch lever member, into a locked position where said protrusion member is fitted into the slot of the second leg portion; and when the flat depression portion is depressed and thereby the latch lever member is pivoted about the two projected fulcrum portions, the claw portion of the transverse portion being disengaged from said triangular protrusion member into an unlocked position where said protrusion member can be released from the slot of the second leg portion.

3. The connector lock device for locking two connector housings as set forth in claim 2, wherein the flat depression portion of the third leg portion of said latch lever member extends outward from the connector housing at an acute angle with respect to the third leg portion.

4. The connector lock device for locking two connector housings as set forth in claim 2, which further comprises two protection walls for supporting said latch lever member therebetween for protection of said latch lever member from being unlocked due to an unexpected external force.

5. The connector lock device for locking two connector housings as set forth in claim 2, which further comprises an annular mounting fixture for mounting said latch lever member on the connector housing.

* * * * *